US007237480B2

(12) United States Patent
Ruddock

(10) Patent No.: US 7,237,480 B2
(45) Date of Patent: Jul. 3, 2007

(54) MANUALLY OPERATED TRASH COMPACTOR

(76) Inventor: Donovan Ruddock, 34 Rubydale Gardens, Weston, Ontario (CA) M9L 1B9

( * ) Notice: Subject to any disclaimer, the term of this patent is extended or adjusted under 35 U.S.C. 154(b) by 0 days.

(21) Appl. No.: 10/977,950

(22) Filed: Oct. 29, 2004

(65) Prior Publication Data

US 2005/0217512 A1 Oct. 6, 2005

Related U.S. Application Data

(63) Continuation-in-part of application No. 10/815,244, filed on Mar. 30, 2004, now abandoned.

(51) Int. Cl.
*B30B 1/00* (2006.01)

(52) U.S. Cl. ..... 100/226; 100/246; 100/247; 100/255; 100/283; 100/295

(58) Field of Classification Search ..... 100/226, 100/227, 228, 229 A, 240, 245, 246, 247, 100/281, 283, 233, 293; 241/270
See application file for complete search history.

(56) References Cited

U.S. PATENT DOCUMENTS

| | | | | |
|---|---|---|---|---|
| 3,919,932 | A * | 11/1975 | Basuino | 100/228 |
| 4,658,720 | A * | 4/1987 | Massonnet | 100/226 |
| 5,090,309 | A * | 2/1992 | Lai | 100/226 |
| 6,314,874 | B1 * | 11/2001 | Martorella | 100/226 |
| 6,851,357 | B1 * | 2/2005 | Martorella et al. | 100/226 |
| 6,889,604 | B2 * | 5/2005 | Ernst | 100/226 |

* cited by examiner

*Primary Examiner*—Daniel C. Crane
*Assistant Examiner*—Jimmy T. Nguyen
(74) *Attorney, Agent, or Firm*—Donald W. Meeker

(57) ABSTRACT

A trash container cover has a pivotable lever arm which pivots vertically moving one or two compactor arms slidably connected to the handle. The compactor arm(s) force a horizontal compactor plate down onto the trash in the container to compact it. The lever arm, compactor arm(s) and compactor plate are pivoted into proximal parallel alignment with the cover and in proximity to the cover for storage and move together to open the trash container to deposit or remove trash. The lever arm may clamp down on the cover to serve as a handle for the cover.

7 Claims, 7 Drawing Sheets

MANUALLY OPERATED TRASH COMPACTOR

REFERENCE TO PRIOR PATENTS

This is a continuation-in-part of patent application Ser. No. 10/815,244 filed Mar. 30, 2004.

BACKGROUND OF THE INVENTION

1. Field of the Invention

The present invention relates to trash compactors that use manually applied forces to obtain the necessary motive power for the movable platen thereof and particularly to a compactor that comprises a lever arm hinged to a trash container cover to move vertically relative to the cover for forcing one or two compacting arms down onto a compactor plate to compact the trash, wherein the lever arm, compacting arm(s) and compactor plate are pivotable into proximal parallel alignment for storage in proximity with the cover and move together with the cover to uncover the trash container to deposit or remove trash.

2. Description of the Prior Art

Many trash compactors operate by means of mechanical assistance by motors, screws, hydraulics and the like, which may require attachment to an electrical outlet with consequent energy consumption, and the risk of mechanical failure requiring servicing. Powerful mechanized compactor can be dangerous to limbs or appendages accidentally in the way of a compacting operation. Manually operated compactors have also been provided with complex mechanisms, which do not stow away within the container or cover when not being used.

U.S. Pat. No. 6,314,874, issued Nov. 13, 2001 to Martorella, claims a manual trash compactor having an adjustable arm and stabilizing blocks. The manual trash compactor is for use with a garbage can having an open top end and a closed bottom end. The compactor comprises a hood having an open top end and a bottom end that is attached to a top end of the garbage can. In addition, attached to the hood is a top or substantially closed surface wherein the top surface has at least one hole. There is also an adjustable arm that has a bottom end that is rotatably mounted on the top surface. The adjustable arm also has an opposite top end. Rotatably attached to the top end of the adjustable arm is a lever arm. A first end of the lever arm attaches to the adjustable arm while there is a second end that is spaced opposite the first end. Along the lever arm is a piston having a top end that is rotatably attached to the lever arm. The piston also has a bottom end that extends through the at least one hole in the top surface, with the bottom end extending into the garbage can. A compression plate is attached substantially perpendicular to the piston at the bottom end of the piston. Thus, to manually compress garbage in a garbage can, a user can close the top, and press down on the second end of the lever arm. This act rotates the adjustable arm and the lever arm so that the piston extends down, substantially perpendicular to the bottom end of the garbage can driving the compression plate onto the garbage and compacting the garbage between the compression plate and the bottom end of the garbage can.

U.S. Pat. No. 3,760,718, issued Sep. 25, 1973 to Adornetto, indicates a trash compactor for attachment to containers, such as a trash or garbage can, for compacting the refuse therein. The compactor attachment includes a plunger with a head for pressing against the deposited trash and a lever arrangement for applying successive increments of pressure to the plunger to compact the refuse engaged by the plunger's head.

U.S. Pat. No. 5,730,047, issued Mar. 24, 1998 to Lindsey, is for a portable refuse compacting container including a container for receiving a flexible refuse collection bag of the type typically known as garbage bags or leaf bags. Bulky refuse such as leaves, grass clippings and the like may be placed in the refuse collection bag where these materials are compressed by a compacting plate which is loosely received inside the container. The compacting plate is used to compress the refuse by an attached plunger arm which is affixed to the compacting plate and which is pivotally attached to a compaction lever. The compaction lever is pivotally attached to the edge of the top of the container. The compaction lever may be latched in place on the container. The container is provided with wheels for ease in moving either the full or the empty container from place to place. When the compaction lever is latched to the container, the handle of the compaction lever also serves as a handle for moving the container about on its wheels.

U.S. Pat. No. 1,294,211, issued Feb. 11, 1919 to Webley, illustrates a press adapted for use in connection with an ordinary cylindrical receptacle. The press comprises a pair of ears, means for clamping said ears in engagement with the exterior of the receptacle, friction pads carried by the receptacle engaging surfaces of said ears, a compressor follower, and operating means for said follower connected to said ears.

U.S. Patent Application No. 20030024419, issued Feb. 6, 2003 to Ernst, discloses a lid for fitting to an open-topped refuse container. The lid has a compacting mechanism that comprises a compacting plate mounted under the lid, a telescopically adjustable actuating rod mounted over the lid, and means slidably coupling the plate to the rod through an aperture in the lid such that the rod may be maneuvered from a storage position wherein the rod lies across the lid and the plate is drawn up under the lid to an operative position wherein the rod stands upright over the aperture and may be pushed downwardly through the aperture to push the plate down into the container.

U.S. Pat. No. 5,090,309, issued Feb. 25, 1992 to Lai, describes a waste container that includes a hollow body having an open top end, a cover detachably provided on the open top end, and a press member movably mounted on the cover and having a plate portion disposed horizontally inside the hollow body. The press member is vertically movable inside the hollow body to compress garbage inside the hollow body.

U.S. Pat. No. 3,779,157, issued Dec. 18, 1973 to Ross, Jr., concerns a receptacle for receiving, compacting, storing, segregating, and eventual disposal of the compacted trash. The receptacle comprises an outer holder, an inner removable disposable container, and an overlying combined funnel and cover. The funnel opens into the top of the disposable container. The cover is pivoted to the funnel so as to be swung outwardly therefrom, and is provided with a hole through which a manually actuated compactor or ram may be inserted for crushing the trash.

U.S. Pat. No. 4,050,373, issued Sep. 27, 1977 to Hellmann, provides a manual trash compactor that has a housing, which is adapted to receive therein an exchangeable bag for containing the trash with access means to gain entrance to the bag for depositing of trash within the bag. To compact the trash pressure applying means is provided with a plunger having a compacting head for engagement with the contents of the bag, with gripping means extending outwardly of the housing for moving the plunger axially to reciprocate the head in a compacting direction. Weighting means is associated with the pressure applying means to add weight to the compacting head, and exit means is provided on the housing to permit removal of the compacted bag.

U.S. Pat. No. 5,845,567, issued Dec. 8, 1998 to Fischer, shows a manual trash compactor that includes a box having an open top. The hand operated compactor assembly includes a compactor with a member integrally coupled thereto and extending upwardly therefrom for gripping by a user, whereby the compactor may be manually depressed within the box for allowing the compacting of trash therein.

U.S. Pat. No. 5,042,374, issued Aug. 27, 1991 to Klepacki, describes a trash receptacle compactor for compacting trash in a trash receptacle enclosed in a housing, including a plunger disposed within the housing in alignment with the trash receptacle and lever means outside of the housing and interconnected with the plunger for selectively operating the plunger to compact trash within the receptacle.

U.S. Pat. No. 4,649,813, issued Mar. 17, 1987 to Kehl, discloses a waste compactor apparatus for trash containers of the type with a top assembly having a frame and a pivoting door, which encloses a central opening of the frame. The compactor comprises a pivot means for the door including a pivot member and a socket which enable the door to be retained in its normal position by gravity, but which permits the door to be easily detached from the frame to enable it to be inserted into the trash container to compress material therein. Once the user has completed the compacting step, the door is re-engaged with the frame.

U.S. Pat. No. 4,331,074, issued May 25, 1982 to Behman, indicates a combined cover and compactor assembly that may be mounted on a container for trash or other compactable material which has a housing having at least one side wall defining a transfer and compacting chamber therein. The housing has a side opening located in the side wall serving as an inlet to permit the compactable material to be charged into the transfer and compacting chamber, and a lower end opening in registry with the transfer and compacting chamber. The housing is connectable to the container by a housing support that is adjacent and defines the lower end opening to allow compactable material charged into the transfer and compacting chamber through the side opening to either fall or be forced into the container. A retainer assembly including an upper end opening is disposed at the upper end of the housing to releasably support a compactor within the transfer and compacting chamber. The compactor may act as a cover when it is held by the retaining assembly, or may be disengaged from the retaining assembly to move downward to exert compacting force upon the compactable material present in the transfer and compacting chamber.

U.S. Pat. No. 4,128,055, issued Dec. 5, 1978 to Hellmann, puts forth a manual trash compactor that comprises a housing adapted to receive therein a bag having upstanding walls terminating in an open top for depositing the trash, and formed having a base with vertically extending panels extending upwardly from the base and terminating in an upper open end such that a rectangular configuration is formed to gain access to the housing. Pressure applying means for compacting the trash within the bag is provided with weighting means associated with the pressure applying means to increase the weight thereof to facilitate the compacting of the trash within the bag. Retaining means for releasably securing the open top of the bag within the housing during operation of the pressure applying means is utilized and comprises a plate operatively associated with each one of the panels to provide retention of the open top of the walls of the bag in fixed relationship to each one of the panels. Mounting means for pivotally securing each one of the plates with respect to one of the panels between an open position and a closed position is provided for permitting the bag to be removed from the housing in the open position and in the closed position compressing the upstanding walls of the bag against the panels. Latching means for releasably retaining each one of the plates in the closed position is provided such that the bag may be filled with trash.

U.S. Pat. No. 4,991,500, issued Feb. 12, 1991 to Knapp, illustrates a refuse compactor device that has a container housing having an open top end for holding a trash bag in which the bag mouth is in registration with and folded over the open top end of the container for receiving trash to be compacted. The compactor device further includes a compactor plate received within the container housing for manual movement from the open top end of the housing toward the bottom end of the housing to compress refuse material in the trash bag. The housing has ventilation apertures in its side wall and bottom to allow air trapped between the bag and the side walls of the housing to be expelled from the container. The compactor plate also has ventilation apertures to allow air included in the refuse to be expelled from the container as the plate is moved into the trash bag and housing. The compactor plate further has an opening to receive therethrough the mouth end of the bag for convenient closing of the bag mouth.

U.S. Pat. No. 4,658,720, issued Apr. 21, 1987 to Massonnet, provides a refuse bin incorporating compacting means wherein the compacting plate comprises two upwardly oriented tabs which are placed in housings in the lid to be slidably associated with a control member. Catches facing opposite each other and borne by said tabs come into slides in the control member embedded in a groove in the lid. In this way, by subjecting the control member to a translation, it may, at the end of a stroke, be pivoted with respect to the catches in order to orient it vertically with a view to vertically actuating the compacting plate.

U.S. Pat. No. 4,286,515, issued Sep. 1, 1981 to Baumann, shows a compacting wastebasket comprising a container closed by a lid for receiving and compacting waste paper. The compacting wastebasket includes a volume-occupying lid, which fits inside the container. The container defines a chamber large enough to accommodate individual pieces of waste to be deposited and compacted. The lid is retained in the container-closing position.

U.S. Pat. No. 5,115,736, issued May 26, 1992 to Rodolico, claims a compaction container for domestic solid waste. A cylindrical container is provided with a cover to be firmly fitted thereon having a bayonet coupling and supports for a lever multiplier to supply to a rack rod a force "n" times stronger than the one applied to the levers, the lever multiplier being integral with a cylinder which slides inside a housing with cuts fitted in the cover center to allow a constant compression according to the heap height; force is transmitted onto the waste to compress it with a piston, which is firmly connected with a nut to the lower part of the rack rod.

U.S. Pat. No. 3,929,060, issued Dec. 30, 1975 to Burke, puts forth a vehicle litter compactor for attachment to the interior of an automobile or the like for compressing accumulated litter in the vehicle. The compactor has a slidable piston mounted in an elongated case with an opening in one side of the casing. The piston is attached to a sliding shaft passing through one end of the casing and may be withdrawn past the opening for insertion of litter, and then the operator may push the shaft and piston to compress the litter in the opposite end of the casing. The casing has a removable end portion for removing the compacted litter.

U.S. Pat. No. 2,465,839, issued Mar. 29, 1949 to Bloomfield, is for a waste container that comprises an open top receptacle; an open top housing for the receptacle provided with a swingable lid for closing the top thereof; a plunger reciprocally carried by the lid for movement to and from a position in the waste receptacle to compress the waste therein; and springs attached to the plunger for holding the same inoperative above the top of the receptacle, said plunger having a head thereon substantially the same diameter as the receptacle. The head is disposed above the receptacle when in the inoperative position.

What is needed is an inexpensive, easy-to-use manual trash compactor which fits on any trash container with components that store out of the way in normal usage of the trash container and are easily manipulated for use in compacting the trash in the container.

SUMMARY OF THE INVENTION

An object of the present invention is to provide an inexpensive, easy-to-use manual trash compactor which fits on any trash container with components that store out of the way in normal usage of the trash container and are easily manipulated for use in compacting the trash in the container.

In brief, a lever arm is hinged at one end to an edge on the top of a trash container cover. The handle has a slot along most of the length of the handle. A vertical compacting arm or pair of compacting arms pivotally connected have a top end of one arm which fits slidably within the slot of the lever arm. The compacting arm(s) passes downwardly through a hole in the cover. A bottom end of the compacting arm(s) is pivotally or slidably attached to a compactor plate so that during compacting the lever arm presses down on the compacting arm(s) which forces the compactor plate to compact the trash in the trash container. The top of one of the compacting arms slides in the lever arm slot as the lever arm pivots vertically relative to the cover.

An embodiment with a single compacting arm or shaft, the shaft is removed from the compactor plate, pulled up out of the container and attached in the lever arm slot for storage, and the compactor plate is snapped under the cover for storage during normal use of the trash container with the lever arm snapped into a clamp on the other edge of the cover from the hinge so that the lever arm can be used as a handle to lift the cover for throwing trash in the container and removing trash from the container.

A preferred embodiment with a pair of compacting arms pivotally pinned together at the midpoints has one arm slidably connected to the lever arm and pivotally connected to the compactor plate and the other arm pivotally attached to the lever arm and slidably attached to the compactor plate so that the compacting arms pivot into parallel alignment with the compacting plate and lever arm for storage in proximity to the cover. Pivoting the lever arm up forces the compacting arms down in a scissor-like movement forcing the compactor plate down onto the trash to compact it. Pivoting the lever arm down into a recess on top of the cover raises the compacting arms and compactor plate into parallel proximity to the cover below the cover, so that all move together to uncover the trash container. The cover may be hinged to the trash container.

An advantage of the present invention is that it provides an inexpensive, easy-to-use manual trash compactor which fits on any trash container with components that store out of the way with the cover in normal usage of the trash container and are easily manipulated for use in compacting the trash in the container.

A further advantage of the present invention is that it provides a safe trash compactor which will not cause serious injury.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 12:
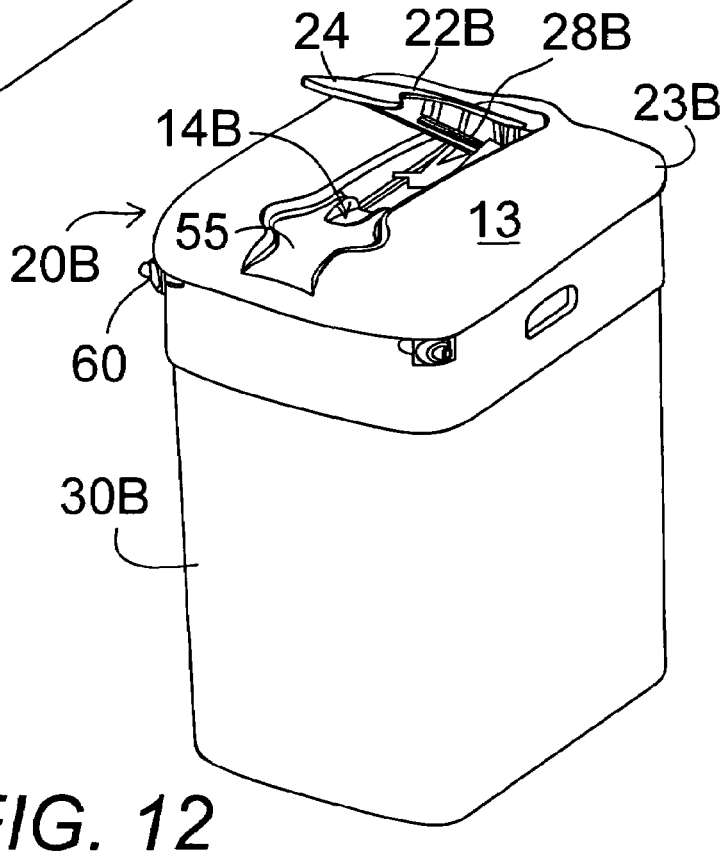
FIG. 12 is a perspective view of a trash container and cover of the preferred embodiment of the invention of FIG. 8 showing the lever arm raised for compacting with the cover closed.
Figure 13:
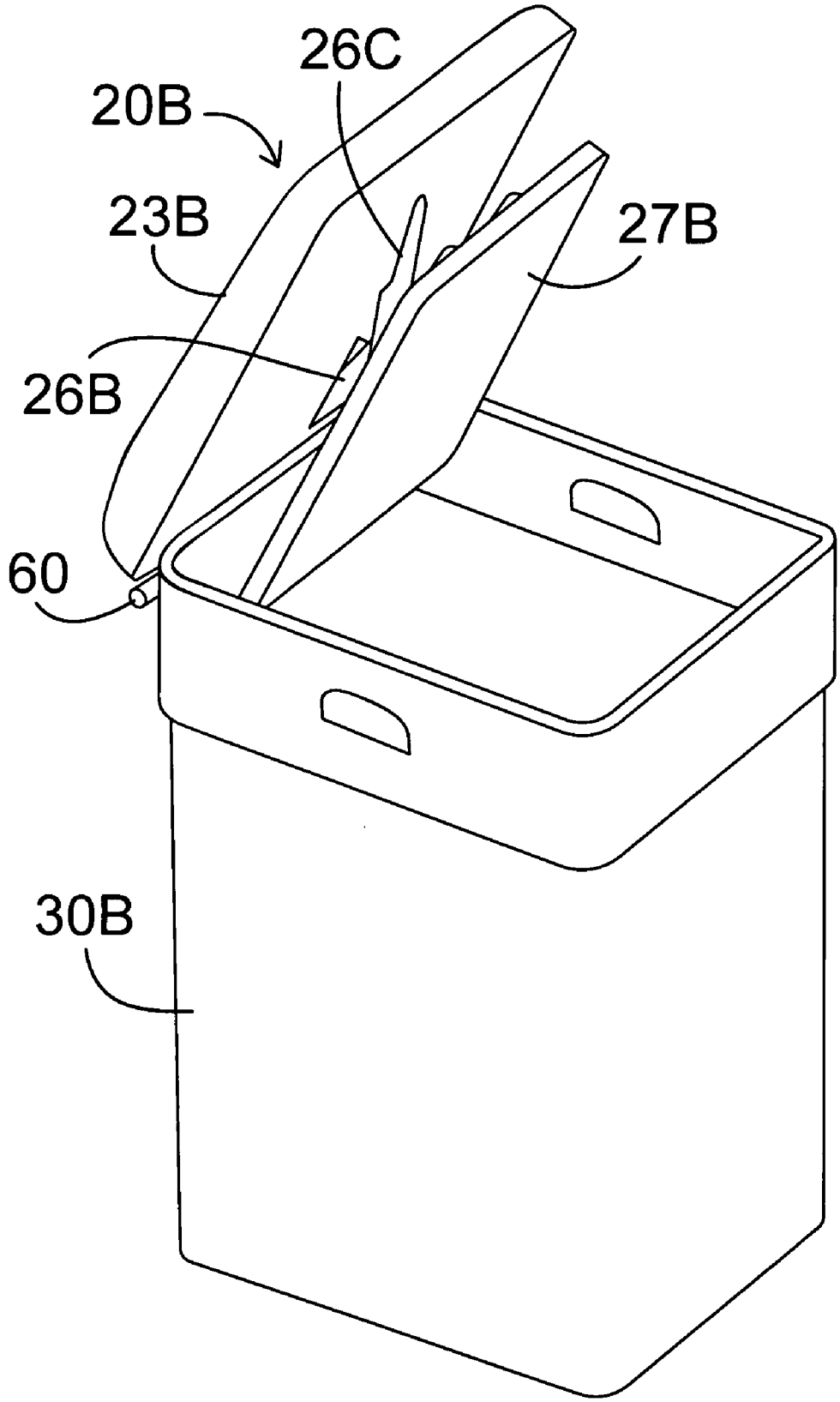
FIG. 13 is a perspective view of a trash container and cover of the preferred embodiment of the invention of FIG. 8 showing the compacting arms and the compactor plate pivoted together in proximity to the bottom of the cover with the cover pivoted open to deposit or remove trash.

In FIGS. 1–13, a manual trash compactor device 20, 20A, and 20B which fits on any trash container 30, 30A, and 30B with components that store out of the way in normal usage of the trash container, as in FIG. 13 and are easy to use in compacting the trash in the container.

The trash can cover 23, 23A, and 23B is adapted to fit securely and removably on a trash container 30, 30A, and 30B. The cover 23, 23A, and 23AB comprises a top surface 13 having a central opening 14 therethrough, a pivot means 18, preferably a bracket and pin, at one edge of the top surface, a peripheral rim 12, 12A and 12B extending downwardly from the top surface for engaging a top of a trash container 30, 30A, and 30B to cover the trash container. The embodiment of FIGS. 1–7 also has a latch or clamp means 17 at an opposite edge of the top surface to hold down the lever arm 22. The peripheral rim 12 and 12A of the embodiment of FIGS. 1–7 has a series of tabs 15 around the bottom 11 of the cover 23 and 23A serving as a means for storing the compactor plate 27 and 27A or any flat object under the cover.

Figure 1:
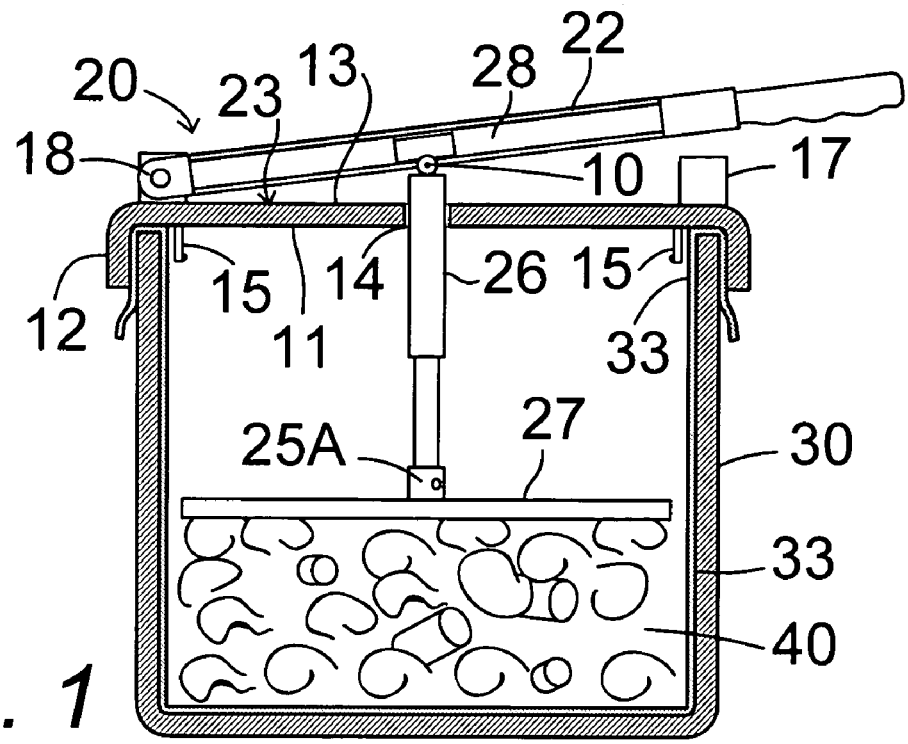
FIG. 1 is a cross-sectional view of a trash container with the cover, lever arm, vertical shaft, and compactor plate of the present invention showing the lever arm pressing down the single compacting arm or vertical shaft onto the compactor plate to compact the trash in the trash container.
Figure 2:
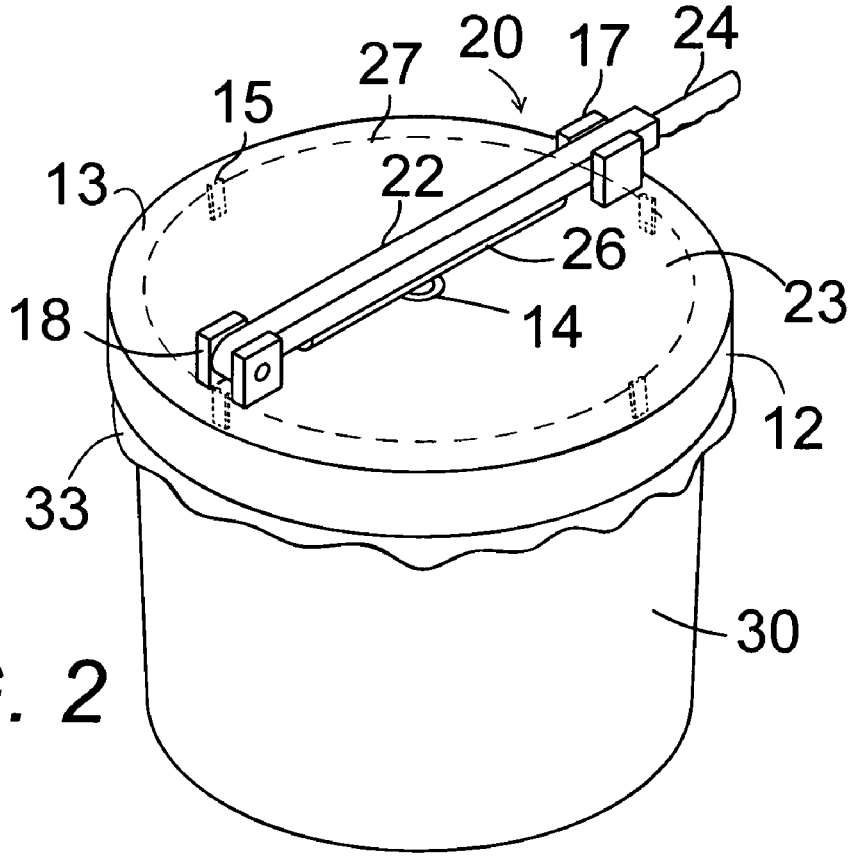
FIG. 2 is a perspective view of the circular cross-section trash container and components of the invention of FIG. 1 showing the compactor plate (dashed) stored in the bottom of the cover and the compacting arm stored in the lever arm which is attached to the cover by a pivot connection at one end and a removable clamp at the other end to serve as a handle for the cover in depositing trash in the trash container and removing trash from the trash container.
Figure 5:
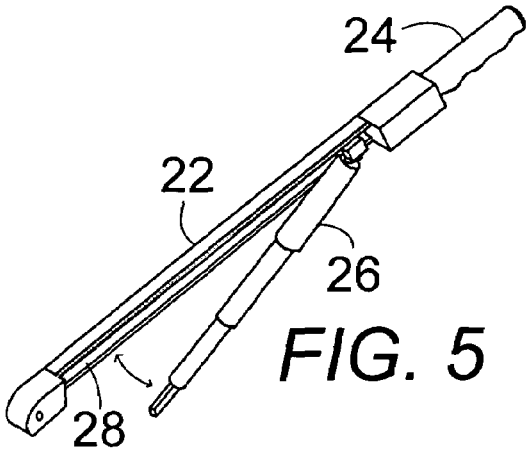
FIG. 5 is a broken perspective view in partial section of the lever arm showing the compacting arm being pivoted into the slot of the lever arm for storage.
Figure 6:
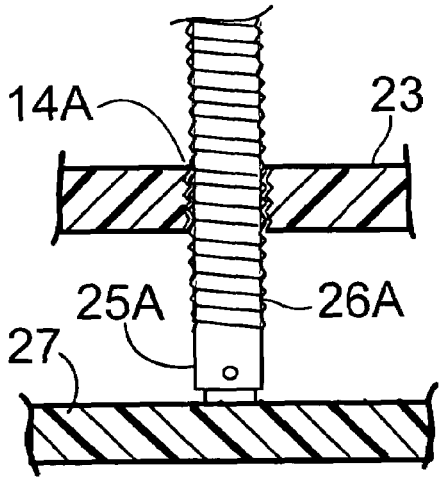
FIG. 6 is a partial cross-sectional view taken through the cover and the compactor plate showing an alternate threaded compacting arm and threaded central hole in the cover.
Figure 7:
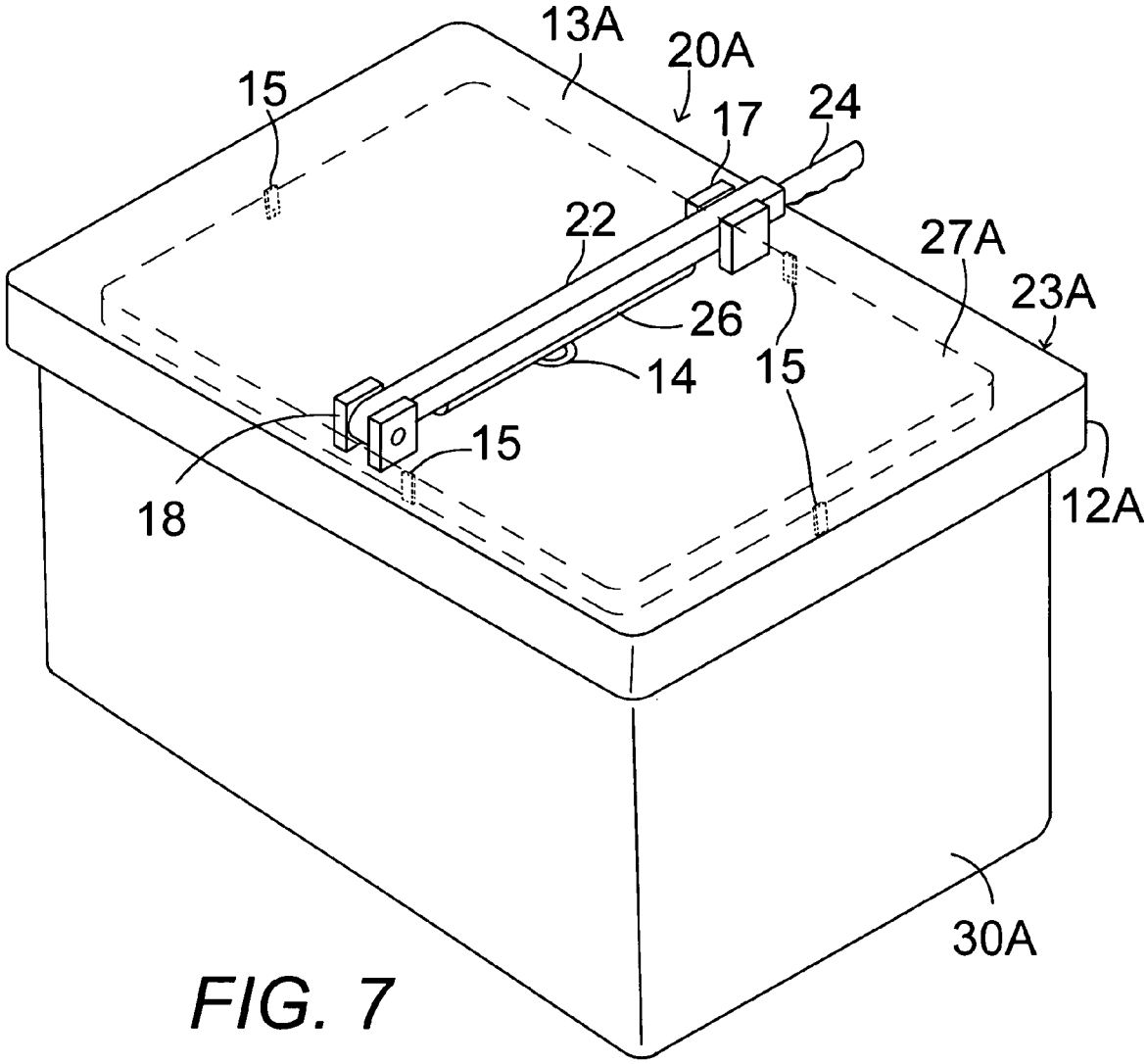
FIG. 7 is a perspective view of a rectangular cross-section trash container with a rectangular cover and rectangular compactor plate.

A lever arm 22, 22A, and 22B is pivotally attached at a first end to the pivot means 18 of the cover 23, 23A and 23B so that the lever arm is vertically pivotable relative to the cover using an end hand grip 24, with a pin through the end of the lever arm and, in the embodiments of FIGS. 1–7 removable attachable at a second end to the clamp means 17 which holds the lever arm 22 and 22A with a tight friction fit so that the lever arm acts as a handle for lifting the cover 23 and 23A with the second end of the handle fixed in the clamp means 17 as shown in FIGS. 2 and 7. The lever arm 22, 22A, and 22B has a slot 28 through most of the length of the lever arm.

At least one trash compacting arm 26, 26A, and 26B/26C is attached to the lever arm by at least one connection 29 and 53 which is slidable in the slot 28 of the lever arm, the trash compacting arm extendable through the opening 14, 14A, and 14B in the cover into a trash container. The trash compacting arm is movable vertically within the trash container when the lever arm is pivoted relative to the trash container cover, the at least one trash compacting arm slidable in the at least one slot of the lever arm handle during a compacting activity.

A compactor plate 27, 27A, and 27B is configured to slide vertically within a trash container 30, 30A, and 30B respectively, with the compactor plate in a horizon orientation. The compactor plate has a means of connecting a bottom of the at least one trash compacting arm to a top of the compactor plate so that during a compacting activity, the lever arm 22, 22A, and 22B is pivotable in a first vertical direction relative to the trash container cover 23, 23A, and 23B to move the at least one trash compacting arm downwardly into a trash container to force the compactor plate to compact a quantity of trash 40 in the trash container.

Alternately, after a compacting activity, the lever arm is pivotable in a second vertical direction relative to the cover to raise the at least one trash compacting arm and the compactor plate upwardly within the trash container into proximity with the cover and the at least one trash compacting arm is pivotable into parallel alignment with the compactor plate.

During use of the trash container for depositing trash in and removing trash from the trash container, the lever arm, the at least one trash compacting arm, and the compactor plate are storable together in proximity to the trash container cover so that the cover, the lever arm, the at least one trash compacting arm, and the compactor plate are movable together to uncover the trash container to allow deposit of trash in the trash container and removal of trash from the trash container, as seen in FIG. 13.

Figure 3:
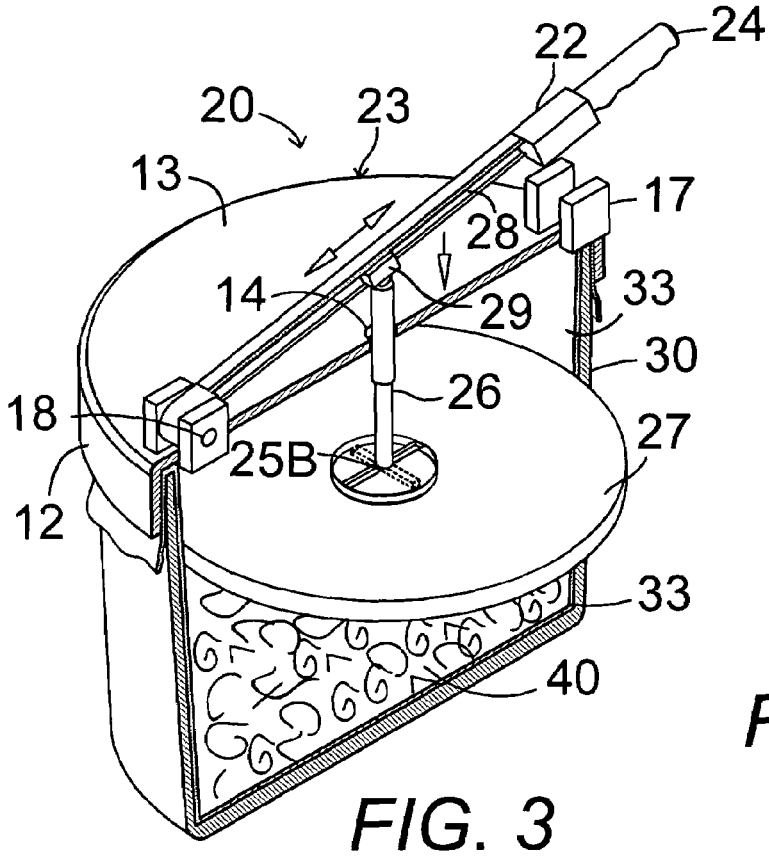
FIG. 3 is a broken perspective view in partial section of the trash container and the present invention of FIG. 1 showing how the pivotable top of the compacting arm slides in a slot in the lever arm when the lever arm is pivoted down to compact the trash.
Figure 4:
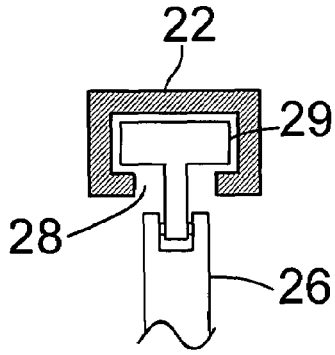
FIG. 4 is a cross-sectional view of the pivotable top of the compacting arm in the slot of the lever arm.

In the embodiments of FIGS. 1–7, the trash compacting arm comprises a vertical shaft 26 and 26A is connected by a pivot pin 10 to a pivotable top end 29 which fits slidably within the slot 28 underneath the lever arm 22 and which shaft 26 and 26A is adapted for passing downwardly through the central opening 14 of the cover during a compacting use of the trash container as seen in FIGS. 1, 3, and 6. The vertical shaft is further adapted for storing within the slot 28 of the lover arm 22 during trash placement in the container and trash removal from the container as seen in FIGS. 2 and 7. FIG. 5 shows the vertical shaft 26 being pivoted into the slot 28 of the lever arm 22 for storage.

A compactor plate 27, 27A, and 27B is configured to slide vertically within the trash container 30, 30A, and 30B, with the compactor plate in a horizon orientation, such as the circular compactor plate 27 shown in FIGS. 2 and 3 adapted for vertical motion in the circular cross-section trash container 30 and the rectangular compactor plate 27A, shown in FIG. 7, adapted for vertical motion in the rectangular cross-section trash container 30A and the molded compactor plate 27B with rounded corners of FIGS. 8–10 and 13 adapted for vertical motion in the rectangular trash container 30B with rounded corners of FIGS. 8, and 11–13.

In the embodiment of FIGS. 1–7, the compactor plate 27 and 27A has a top center means, such as the snap fit rotatable connector 25A of FIGS. 1 and 6 or the pivotable connector 25B, shown in FIG. 3 with a T-end of the shaft insertable through a slot in the compactor plate and pivoted closed for removably connecting a bottom of the shaft to a top of the compactor plate.

During compacting, as shown in FIGS. 1, 3, and 6, the lever arm 22 presses down on the vertical shaft 26 and 26A which forces the compactor plate 27 to compact the trash 40 in the trash container 30 with the top 29 of the shaft sliding in the handle slot 28 as the lever arm 22 pivots downwardly.

During use of the trash container 30 and 30A for depositing trash 40 in and removing trash from the trash container or leaving the trash covered, the shaft 26 is adapted to be removable from the compactor plate 27 and 27A, and to be removable up out of the container and to be attachable in the slot 28 in the bottom of the lever arm handle 22 for storage, as shown in FIGS. 2, 5, and 7. The compactor plate 27 and 27A is adapted to be storable under the cover 23 and 23A in contact with the tabs 15 on the bottom 11 of the cover 23 and 23A.

In FIGS. 1, 3, and 5, the vertical shaft 26 is a telescoping shaft adapted to telescope outwardly to a desired compacting length for compacting trash 40 in a trash container 30, as shown in FIGS. 1 and 3, and telescope inwardly to a desired storage length for storage in the slot 28 in the handle 22, as shown in FIGS. 2 and 7.

Alternately, in FIG. 6 the central opening 14A in the cover 23 is a threaded opening and the vertical shaft 26A is a threaded shaft adapted to screw down through the central opening in the cover for compacting trash in a trash container.

In the preferred embodiment of FIGS. 8–13, the trash compactor arm comprises a pair of elongated rigid trash compactor arms 26B and 26C pivotally interconnected by a pivot pin 52 positioned midway along a length of each of the pair of trash compactor arms. A first of the pair of trash compactor arms 26C is attached by a pivotable connector 59 at a top end to the lever arm 22B or to the cover 23B and attached by a slidable connector, such as a pin 51 at a bottom end to the compactor plate 27B sliding in a pair horizontal slots 50 in a pair of ridges 57 formed on a top side of the compactor plate 27B between which ridges a sliding track 58 for the pivot arm is created. A second of the pair of trash compactor arms 26B is attached at a top end by a slidable connector, such as a pin 53 in the slot 28B of the lever arm 22B with an extender piece 54 between the lever arm 22B and the compactor arm 26B, and attached at a bottom end by a pivotable connector 56 to the pair of ridges 57 of the compactor plate 27B.

Figure 8:
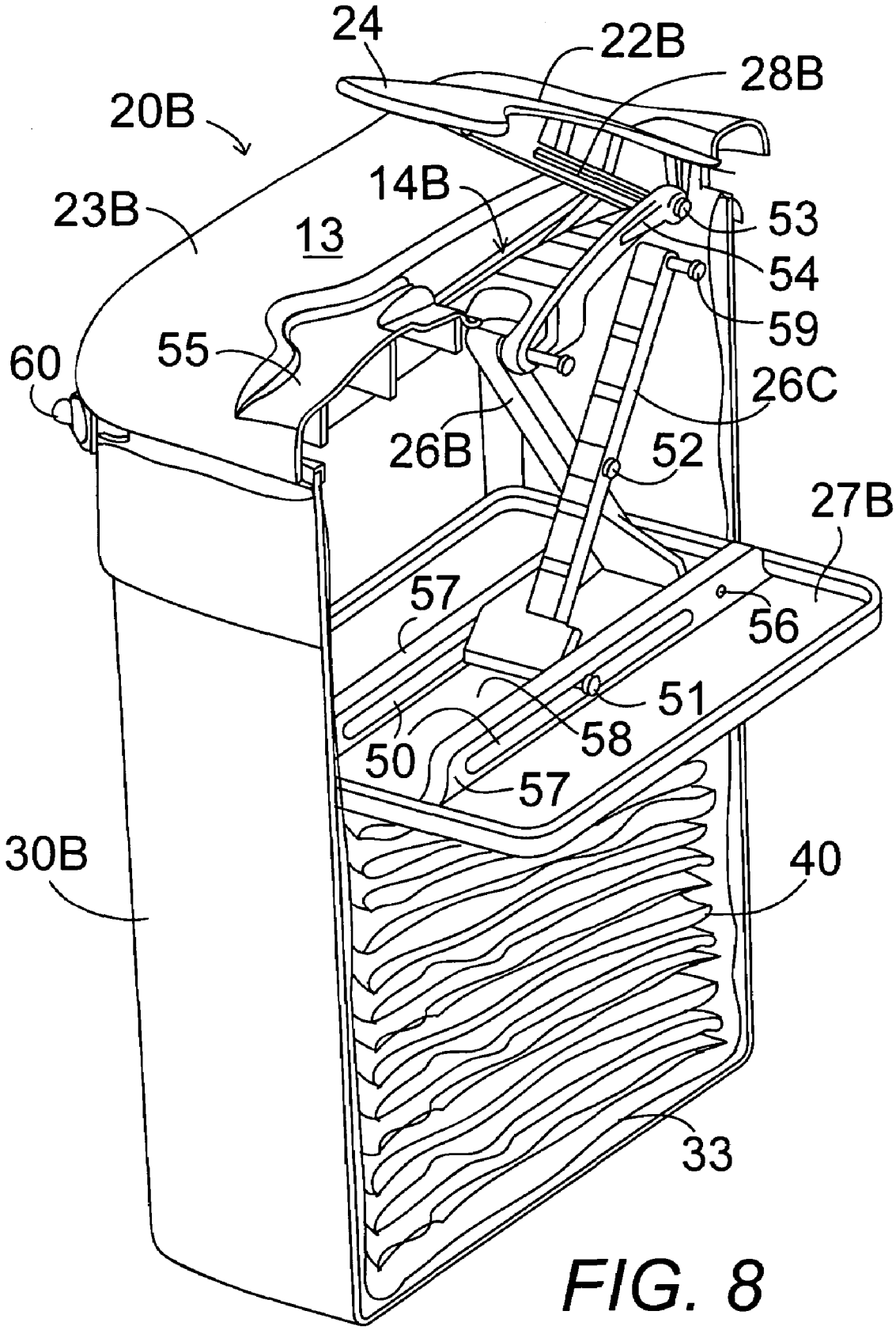
FIG. 8 is a cross-sectional perspective view of a trash container and the cover of the preferred embodiment of the invention having a pair of compacting arms pivotally interconnected with the lever arm being pivoted up to pivot the compacting arms together in a scissor-like movement to extend them down to force the compactor plate down onto the trash in the trash container, compacting the trash.
Figure 9:
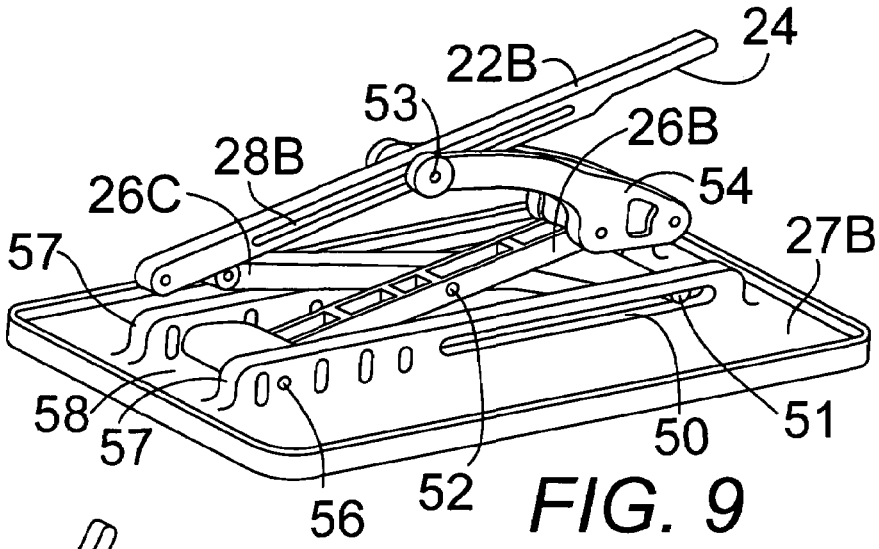
FIG. 9 is a perspective view of the lever arm, compacting arms, and compactor plate of the invention of FIG. 8 showing them pivoted together for storage.
Figure 10:
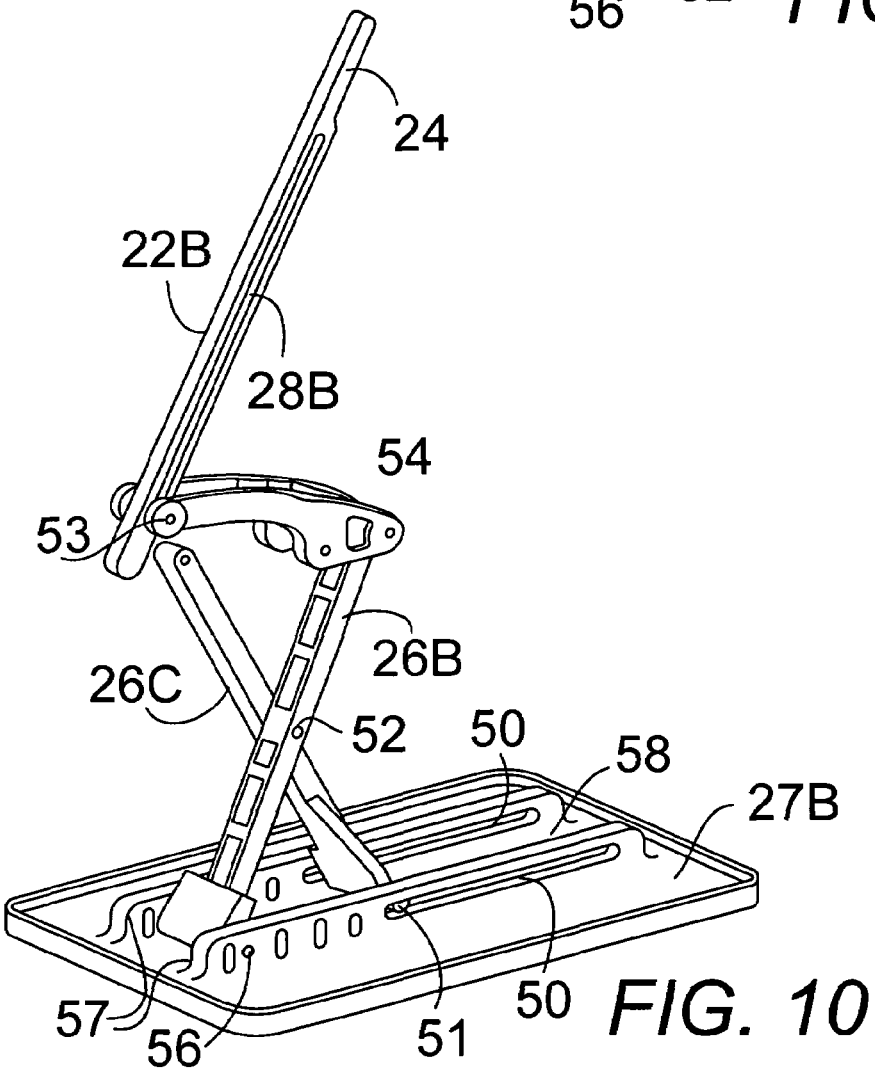
FIG. 10 is a perspective view of the lever arm, compacting arms, and compactor plate of the invention of FIG. 8 showing the lever arm raised, the compacting arms extended downwardly, and the compacting plate down for compacting.
Figure 11:
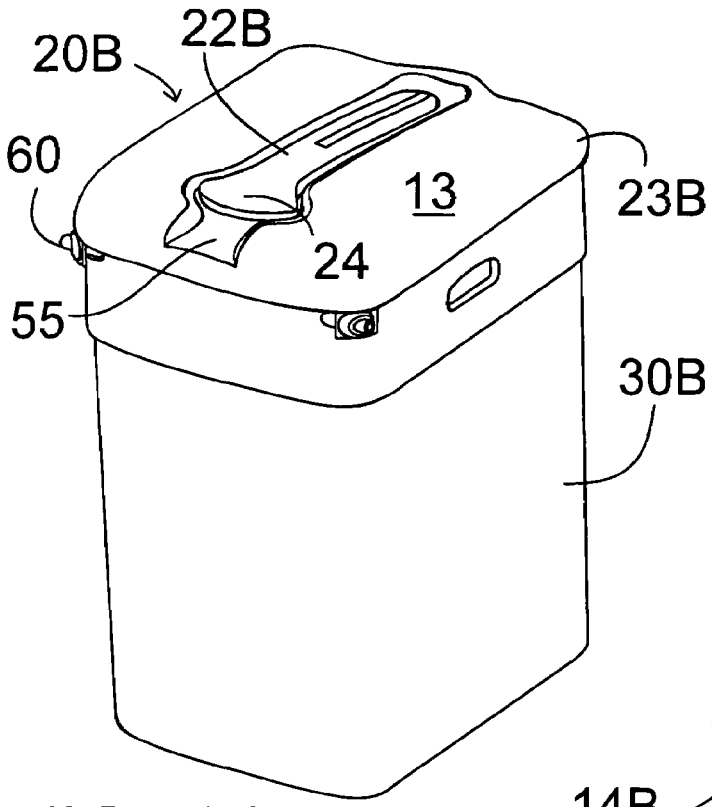
FIG. 11 is a perspective view of a trash container and cover of the preferred embodiment of the invention of FIG. 8 showing the lever arm lowered into the recess in the top of the cover with the cover closed.

When the lever arm 22B is pivoted upwardly from the trash container cover 23B, as in FIGS. 8, 10, and 12, the pair of trash compacting arms 26B and 26C move in a scissor-like motion to extend downwardly into a trash container with a force of at least 450 pounds due to leverage moving the compactor plate 27B downwardly to compact a quantity of trash 40 in a trash container 30B, as in FIG. 8, and when the lever arm 22B is pivoted downwardly toward the trash container cover 23B into a recess 55 on a top surface 13B of the cover 23B, the compacting arms 26B and 26C pivot up together and raise the compactor plate 27B into parallel proximity to the cover below the cover, so that all move together to uncover the trash container, as in FIG. 13. The cover 23B may be attached to the trash container 30B by a hinge 60.

As seen in FIGS. 1, 3, and 8, the compacting plate 27, 27A and 27B is configured in a shape conformable to and smaller than a horizontal cross-section of a trash container 30, 30A, and 30B so that the compacting plate is adapted for moving vertically within the container with a trash bag 33 between the compacting plate 27 and the trash container 30, 30A, and 30B.

The components are preferably fabricated of a strong synthetic material molded into the desired configurations.

It is understood that the preceding description is given merely by way of illustration and not in limitation of the invention and that various modifications may be made thereto without departing from the spirit of the invention as claimed.

What is claimed is:

1. A manual trash compactor device which fits on any trash container with components that store out of the way in normal usage of the trash container and arc readily brought into use in compacting the trash in the container, the device comprising:

a trash container cover configured to fit securely and removably over a top of a trash container, the trash container cover comprising a pivot means at one edge of a top surface, an opening through the trash container cover, and a peripheral rim extending downwardly from the top surface for engaging a top of a trash container to cover the trash container;

a lever arm pivotally attached at a first end to the pivot means of the cover so that the lever arm is vertically pivotable relative to the cover, the lever arm having a slot along a portion of the length of the lever arm;

at least one trash compacting arm attached to the lever arm by a connection which is slidable in the slot and along the portion of the length of the lever arm, the at least one trash compacting arm extendable through the opening in the cover into a trash container and the at least one trash compacting arm movable vertically within a trash container when the lever arm is pivoted relative to the trash container cover, the at least one trash compacting arm slidable in the slot and along the portion of the length of the lever arm during a compacting activity;

a compactor plate configured to slide vertically within a trash container with the compactor plate in a horizon orientation, the compactor plate having a means for connecting a bottom of the at least one trash compacting arm to a top of the compactor plate so that during a compacting activity, the lever arm is pivotable in a first vertical direction relative to the cover to move the at least one trash compacting arm downwardly into a trash container to force the compactor plate to compact a quantity of trash in a trash container and alternately after a compacting activity, the lever arm is pivotable in a second vertical direction relative to the cover to raise the at least one trash compacting arm and the compactor plate upwardly within the trash container into proximity with the cover and the at least one trash compacting arm is pivotable into parallel alignment with the compactor plate, and during use of the trash container for depositing trash in and removing trash from the trash container, the lever arm, the at least one trash compacting arm, and the compactor plate are storable together in proximity to the trash container cover so that the cover, the lever arm, the at least one trash compacting arm, and the compactor plate arc movable together to uncover the trash container to allow deposit of trash in the trash container and removal of trash from the trash container.

2. The device of claim 1 wherein the at least one trash compactor arm comprises a pair of elongated rigid trash compactor arms pivotally interconnected by a pivot pin positioned midway along a length of each of the pair of trash compactor arms and a first of the pair of trash compactor arms is attached by a pivotable connector at a top end to the lever arm and attached by a slidable connector at a bottom end to the compactor plate, and a second of the pair of trash compactor arms is attached at a top end by a slidable connector in the at least one slot of the lever arm and attached at a bottom end by a pivotable connector to the compactor plate, so that when the lever arm is pivoted upwardly from the trash container cover the pair of trash compacting arms move is a scissor-like motion to extend downwardly into a trash container moving the compactor plate downwardly to compact a quantity of trash in a trash container and when the lever arm is pivoted downwardly toward the trash container cover the rigid trash compacting arms pivot upwardly and the compactor plate is moved upwardly adjacent to the trash container cover.

3. The device of claim 1 wherein the at least one trash compacting arm comprises a vertical shaft attached at a top end to the lever arm by a pivotable connector which fits slidably within the slot in the lever arm and removably attachable to the compactor plate as a bottom end, which shaft extends from the lever arm downwardly through the at least one opening of the cover with a bottom end of the vertical shaft attached to the compactor plate during a compacting activity and the lever arm is provided with an elongated recess in a bottom side of the lever arm structured to receive the vertical shaft therein and with a bottom end of the vertical shaft released from the compactor plate, the vertical shaft being pivotable up to fit within the lever arm for storing within the elongated recess of the lever arm for storage during trash placement in the container and trash removal from the container.

4. The device of claim 3 wherein the vertical shaft is a telescoping shaft for telescoping outwardly to a desired compacting length for compacting trash in a trash container and telescoping inwardly to a desired storage length for storage in the elongated recess in the lever arm.

5. The device of claim 3 wherein the cover further comprises a series of tabs protruding from a bottom surface of the cover and the compacting plate is adapted to snap fit into a bottom of the cover with the compacting plate engaging the series of tabs.

6. The device of claim 1 wherein the cover is formed with a peripheral rim in a shape conformable to and mating with a rim of a trash container.

7. The device of claim 1 wherein the compacting plate is configured in a shape conformable to and smaller than a horizontal cross-section of a trash container so that the compacting plate is adapted for moving vertically within the container with a trash bag between the compacting plate and the trash container.

* * * * *